United States Patent [19]

White

[11] Patent Number: 4,467,928

[45] Date of Patent: Aug. 28, 1984

[54] PENDANT SUPPORTED BOOM WITH FIXED AND LIVE PENDANT PORTIONS

[75] Inventor: Bruce W. White, Nicholasville, Ky.

[73] Assignee: FMC Corporation, Chicago, Ill.

[21] Appl. No.: 393,983

[22] Filed: Jun. 30, 1982

[51] Int. Cl.[3] ..... B66C 23/06

[52] U.S. Cl. ..... 212/182; 212/239; 212/255; 212/262; 212/267

[58] Field of Search ..... 212/175, 182–187, 212/230, 231, 239, 240, 255, 256, 260, 262, 154, 179, 264; 52/116–118

[56] References Cited

U.S. PATENT DOCUMENTS

| | | | |
|---|---|---|---|
| 2,868,392 | 1/1959 | Poffenberger | 212/8 |
| 2,999,600 | 9/1961 | Gates | 212/55 |
| 3,187,906 | 6/1965 | Bushong et al. | 212/186 |
| 3,308,967 | 3/1967 | Barkley et al. | 212/55 |
| 3,362,022 | 1/1968 | Mork et al. | 212/154 |
| 3,371,799 | 3/1968 | Brownell et al. | 212/35 |
| 3,727,359 | 4/1973 | Vonck | 52/121 |
| 3,856,151 | 12/1974 | Lamer | 212/55 |
| 4,053,058 | 10/1977 | Jensen et al. | 212/8 |
| 4,133,411 | 1/1979 | Curb | 182/2 |
| 4,156,331 | 5/1979 | Lester et al. | 52/115 |
| 4,336,889 | 6/1982 | McGrew | 212/179 |
| 4,352,434 | 10/1982 | Poock | 212/264 |

*Primary Examiner*—Trygve M. Blix
*Assistant Examiner*—Stephen P. Avilla
*Attorney, Agent, or Firm*—A. J. Moore; H. M. Stanley; R. B. Megley

[57] ABSTRACT

A pendant supported extensible boom is disclosed having the boom and a live mast pivoted to a base about an axis near the lowermost surface of the boom for providing a stowed mast-boom angle of about 10°, and a fixed length pendant is provided to maintain a predetermined mast-boom working angle. A live pendant is trained over a winch, a boom supporting hoist, and a pendant take-up hoist connected between the mast and an outer end portion of the boom. Driving the winch to haul in pendant controllably raised the mast to its mast-boom working angle and then raises the boom to its desired working angle. When extending or retracting the boom, the boom working angle is maintained constant by paying out pendant from the winch, respectively. The boom and mast are controllably returned to a stowed position by paying out line from the boom supporting hoise and pendant take-up hoist.

6 Claims, 4 Drawing Figures

PENDANT SUPPORTED BOOM WITH FIXED AND LIVE PENDANT PORTIONS

CROSS REFERENCE TO RELATED APPLICATIONS

The present invention is similar to the inventions disclosed in the following copending applications assigned to the assignee of the present invention:

Poock application Ser. No. 145,529 which was filed on May 1, 1980 which issued on Oct. 5, 1982 as U.S. Pat. No. 4,352,434 entitled Pendant Supported Hydraulic Extensible Boom.

Cozad application Ser. No. 293,727 which was filed on Aug. 17, 1981 and is entitled Low Droop Multi-Part Pendant Supported Boom.

Scherman applicaton serial No. 393,984 which was filed on June 30, 1982 entitled Pendant Control System For Pendant Supported Boom, and filed on even date herewith.

Poock application Ser. No. 393,985 which was filed on June 30, 1982 entitled External Pendant Pay-out System With Anti-Droop Control, and filed on even date herewith.

Poock et al application Ser. No. 393,986 which was filed on June 30, 1982 entitled Floating Sheave Type Pendant Pay-out System For Pendant Supported Boom, and filed on even date herewith.

BACKGROUND OF THE INVENTION

1. Field of the Invention

The present invention relates to multi-section pendant supported telescopic booms and more particularly relates to a pendant system having a fixed pendant portion for establishing a predetermined mastboom working angle, and a single pendant portion for maintaining the boom angle substantially constant during extension and retraction of the boom by paying out and hauling in live pendant, respectively.

2. Description of the Prior Art

Multi-section, pendant supported telescopic booms for cranes or the like are well known in the art. It is also well known that such booms may be supported by pendant ropes that are located entirely externally of the boom, or may be of the types that have external pendant portions as well as internal pendant portions that are reeved around sheaves within the boom. Booms of the type having only external pendant ropes that are attached to, or near, the tip end of the boom and are trained over the upper end of a mast pivoted to the boom tend to raise the boom and decrease the angle between the mast and the boom in response to extension of the boom; and tend to lower the boom tip and to increase the angle in response to retraction of the multi-section boom.

The types of booms which are supported by pendants having both internal and external pendant portions such as the boom disposed in the aforementioned Cozad application, operate in a reverse manner, i.e., the tip drops when extended and raises when retracted.

It is also well known in the art to extend and retract several sections of a multi-section boom with one or two hydraulic rams. U.S. Pat. No. 4,156,331, which issued to Lester et al on May 29, 1979 illustrates such a boom which uses two rams; and U.S. S. Pat. No. 4,133,411 which issued to Curb on Jan. 9, 1979 illustrates a boom operated by a single ram.

SUMMARY OF THE INVENTION

In accordance with the present invention a pivotally mounted telescopic boom having a live mast pivoted thereon is raised and lowered by a single winch having a wire rope trained therearound and around a multi-parts of rope boom hoist (upper to mast rope) which includes a multiple grooved sheave located adjacent the pivoted end of the boom, and a second multiple grooved sheave journaled on the top of the mast. The wire rope is also trained around a multi-parts of the rope pendant take-up hoist (mast to boom head rope) which includes a multiple grooved sheave on the top of the mast and another multiple groove sheave journaled on the outer end of the boom. The boom supporting and take-up hoists enables an operator to controllably raise and lower the mast and boom with a single live pendant and to extend and retract the boom while maintaining the boom angle substantially constant by paying out or hauling in the single live pendant. A fixed length pendant is connected between the top of the mast and the outer end of the base section of the boom for establishing a predetermined mast-boom working angle.

DESCRIPTION OF THE PREFERRED EMBODIMENT

Figure 1:
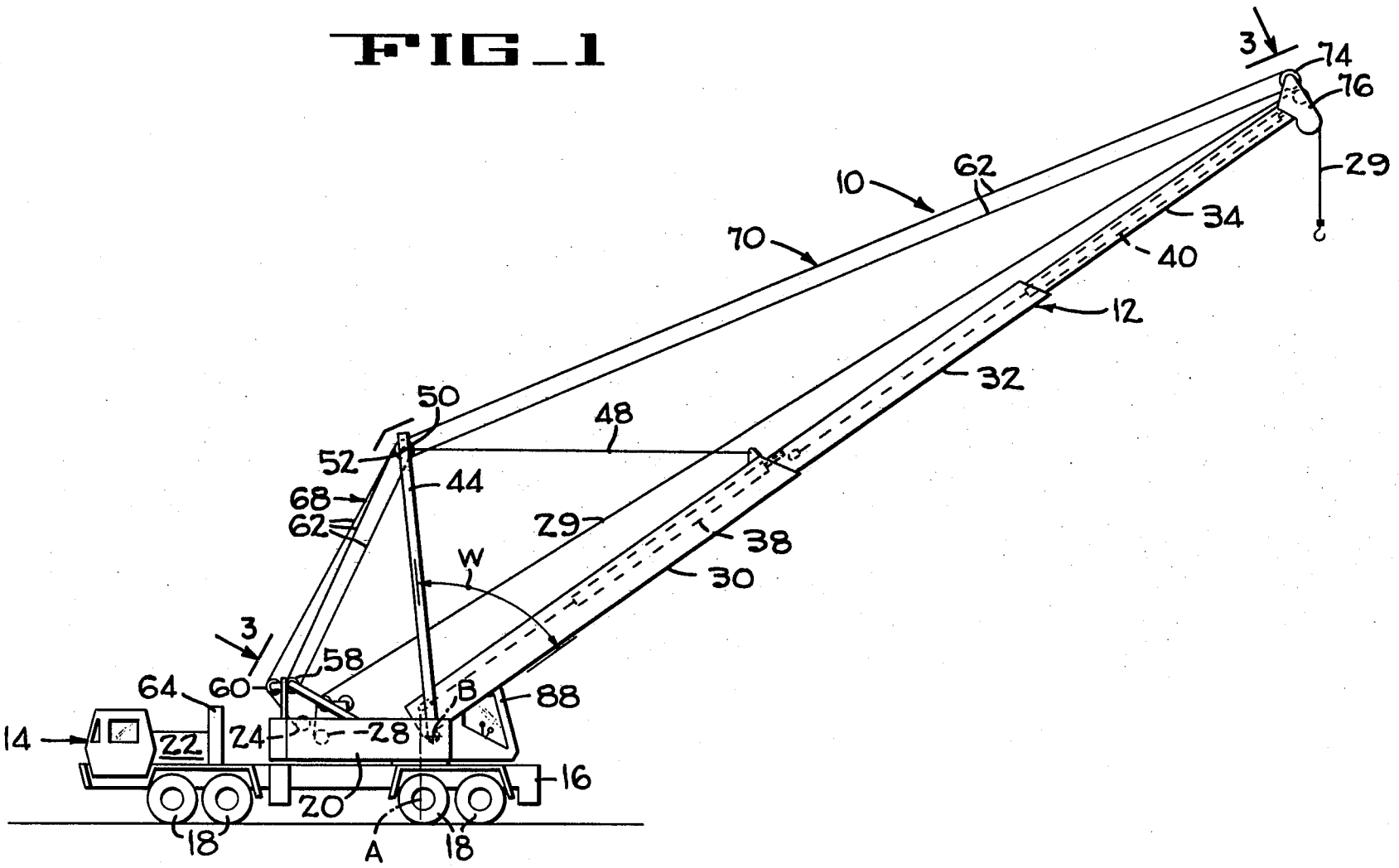
FIG. 1 is a side elevation of a crane with its boom extended and supported in a working position, and with the mast in its predetermined mast-boom working angle.

The pendant pay-out system 10 (FIGS. 1 and 3) of the present invention is illustrated in conjunction with a multi-section extensible boom 12 of a mobile crane 14. The crane 14 (FIGS. 1 and 2) includes a chassis 16 supported on wheels 18 with an upper works or base 20 mounted for rotation on the chassis 16 about a vertical axis A. The crane includes an engine 22 which provides power for driving at least some of the wheels 18, for rotating the upper works 20, and for driving hydraulic pumps and motors which provide power for several winches including a boom supporting and pendant take-up winch 24, and a load line winch 28. The load line winch is provided to raise and lower a load supported by a load line 29 trained over the outer end of the boom.

The boom 12 is illustrated as a three-section boom that is supported by the pendant pay-out system 10, which boom includes a base section 30 pivoted to the upper works 20 about a horizontal axis B, an intermediate section 32, and a tip section 34. The three boom sections are telescopically received within each other in a manner conventional in the art. Also, the boom sections may be extended and retracted in a manner conventional in the art. For example, a first hydraulic cylinder 38 (FIG. 1) connected between the base section 30 and the intermediate section 32 and a second hydraulic cylinder 40 connected between the intermediate section 32 and the tip section 34 may be used for extending and retracting the boom sections under the control of the operator.

A mast 44 is preferably pivoted to the base section 30 of the boom for pivotal movement about horizontal axis B. At least one (preferably two) fixed length pendant line 48 is connected between the upper end of a mast 44 and the outer end of the base section 30. The fixed length pendant 48 is provided to maintain a desired mast-boom working angle W when the boom is elevated to a working position such as illustrated in FIG. 1. A multi-grooved sheave 50 (FIGS 1 and 3) is journaled on a shaft 52 secured to the upper end of the mast 44.

Figure 3:
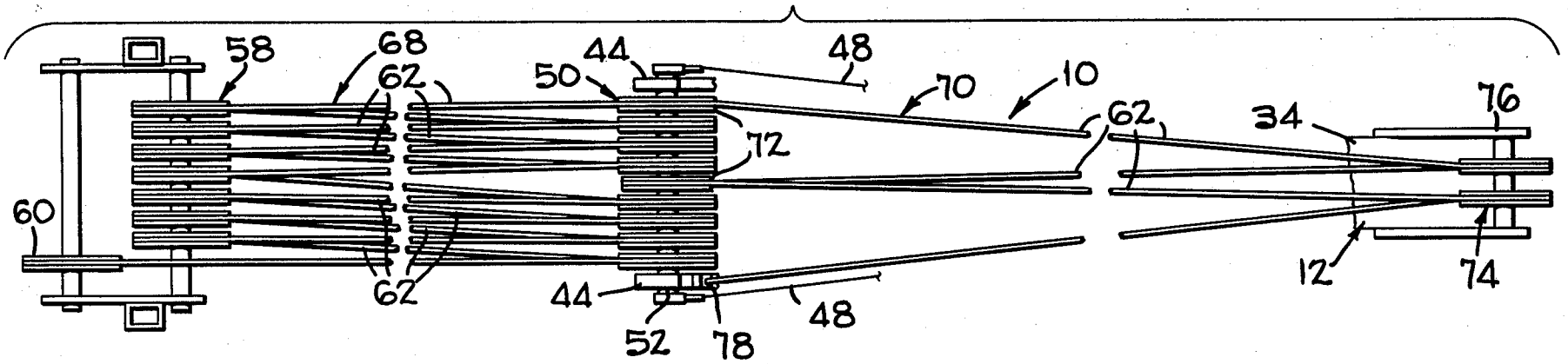
FIG. 3 is an enlarged plan of the boom hoist and the pendant take-up hoist in their working positions, taken in the direction of arrows 3–3, certain parts being cut away to reduce the length of the view.

The mast 44 and boom 12 are raised and lowered by the boom supporting winch 24 which is connected to the multi-grooved sheave 50 (FIGS. 1 and 3), a second multi-grooved sheave 58, and a sheave 60 by a wire rope or live pendant 62 trained over said sheaves as clearly shown in FIGS. 1 and 3. The multi-grooved sheaves 50 and 58 along with a portion of the live pendant 62 defines an upper to mast rope or multiple parts of rope boom hoist 68.

Conventional controls (not shown) are provided to enable the operator to selectively operate the cylinders 38,40 (FIG. 1) to extend and retract the boom sections, and to operate the boom supporting winch 24 to pivotally raise and lower the mast 44 and the boom 12. Also, it will be apparent that the boom 12 and the upper works or base 20 may be pivoted 360° about axis A (FIG. 1), and that the boom may be lowered into transport position against the boom rest 64 as illustrated in FIG. 2.

As best shown in FIGS 1 and 3, the pendant pay-out system 10 includes the boom hoist 68 and a mast to boom head multi-parts of rope hoist 70, which hoist 70 will hereafter be referred to as a pendant take-up hoist. The pendant take-up hoist 70 comprises a portion of the live pendant 62 which is reeved over means defining a multi-groove sheave 72 (FIG. 3) journaled on the shaft 52 on the upper end of the mast 44 and around another multi-grooved sheave 74 journaled on the head machinery 76 at the outer end of the tip section 34. As illustrated in FIG. 3, the free end of the live pendant 62 is anchored to the mast 44 at 78.

The parts of rope of the boom hoist 68 and of the pendant take-up hoist 70 differ, with the parts of rope of the boom hoist 68 being greater than that of the pendant take-up hoist 70. Although the parts of rope may vary with the size of the crane, preferably, the boom hoist 68 includes about 15 parts of rope while the take-up hoist includes about 4 parts of rope. Thus, the ratio of parts of rope and accordingly the mechanical advantage, between the two hoists 68,70 is about 15 to 4. Since each part of rope of live pendant 62 on the two hoists have the same tension, and since the boom hoist 68 has a greater mechanical advantage than that of the pendant take-up hoist 70, it is apparent that the fixed length pendant 48 is required to establish and maintain the desired mast-boom working angle W illustrated in FIG. 1.

Figure 2:
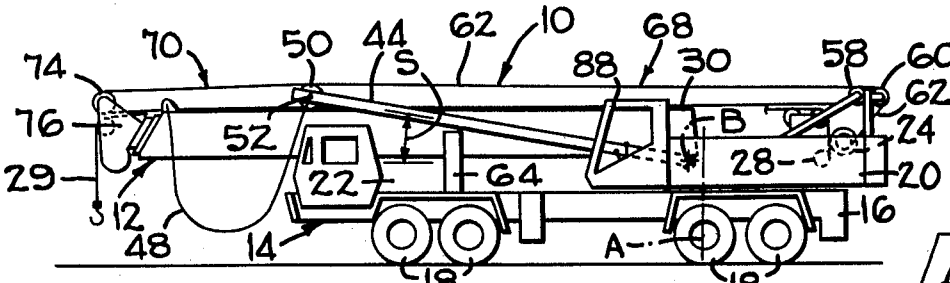
FIG. 2 is a side elevation of the crane with the boom and mast in their lowered transport positions.

It will be noted that by pivotally supporting the lower end of the mast 44 (FIG. 2 to the boom foot or axis B (or to a similar axis adjacent the lower surface of the boom base section 30) that the mast 44 defines a significant stowed mast angle S (about 10°) relative to the longitudinal axis of the boom 12. Thus, the mast 44 may be controllably raised from or lowered onto the boom 12 by the boom hoist 68 even though the boom hoist 68 is substantially horizontal when in its transport position as shown in FIG. 2.

Figure 4:
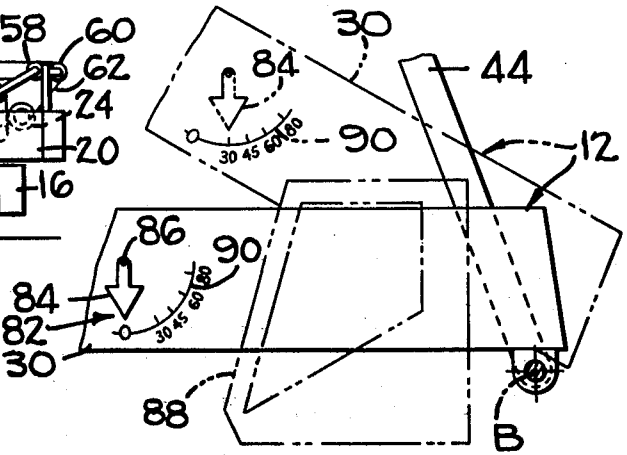
FIG. 4 is an enlarged elevation of a fragment of the boom and mast illustrating a boom angle indicator in two operative positions certain parts being shown in phantom.

As previously indicated, it is desirable to maintain the boom angle substantially constant when extending or retracting the boom 12. In order to aid the operator in detecting angular changes of the boom, any suitable well known boom angle indicator is provided. For example, a boom angle indicator 82 (FIG. 4) is provided and includes a pendulum pointer 84. The pointer 84 is pivoted to the base section 30 of the boom 12 by a connector 86 and is within view of an operator seated in the cab 88. An arcuate scale 90 that is concentric with the connector 86 is marked such as by painting on the side of the base section 30 and is graduated in degrees from 0° to about 80° therefore indicating the angle of the boom relative to the horizontal plane.

In operation, starting from the transport position illustrated in FIG. 2, the operator actuates the winch 24 in a direction which will haul in a portion of the live pendant 62. Since the mast 44 defines a significant angle S relative to the longitudinal axis of the boom when in its transport or stowed position, pendant rope 62 will be drawn in from the boom supporting hoist 68 and will maintain complete control over the mast 44 as it is being moved to its mast-boom working angle W illustrated in FIG. 1. When raising the mast 44, pendant rope 62 will be payed-out into the pendant take-up winch 70. When the mast 44 reaches its mast-boom working angle W, the fixed pendants 48 will be drawn taut. Continued movement of the winch 24 in a pendant haul-in direction will raise the boom 12 to any desired boom working angle up to about 80° from the horizontal. For example, if the operator wishes a 30° boom working angle he may actuate the winch 24 to raise the boom 12 until the boom angle indicator 82 reads 30° as shown in dotted lines in FIG. 4.

The tip of the boom will tend to raise due to boom extension and will tend to fall due to retraction of the boom when the winch 24 is held from rotation unless corrected. Since it is desirable to maintain the boom angle substantially constant when extending or retracting the boom, it is apparent that the operator must control the winch 24 so as to pay-out pendant 62 when extending the boom and haul-in pendant when retracting the boom to maintain a constant boom angle.

When moving the boom from a working position such as illustrated in FIG. 1 to its transport position in FIG. 2, the operator retracts the boom 12 and then actuates controls to pivot the boom 180° about vertical axis A. The operator then pays out pendant 62 from the winch 24 until the boom 12 rests on the boom rest 64. Continued paying out of pendant from the winch 24 will apply equal tension to all parts of rope of the two hoists 68 and 70. Since the boom supporting hoist 68 has more parts of rope than the pendant take-up hoist 70, the upper end of the mast will be subjected to a larger total force from the boom supporting hoist 68 than from the pendant take-up hoist 70. However, sufficient force will be applied by both hoists to maintain all portions of the live pendant taut during lowering of the mast 44. Because of the higher total force exerted by the boom hoist 68 coupled with the significant angle S of the mast relative to the boom when in its stowed position of FIG. 2, the winch 24 maintains complete control of the mast 44 and gently lowers it onto the upper surface of the boom base section. The live pendant 62 is maintained taut due to a conventional spring set brake (not shown) incorporated in the hydraulically actuated winch 24. It is noted that the fixed pendant 48 is slack when in the transport position but may be connected to hooks or the like (not shown) on the base section 30 in order to maintain the fixed pendant in a desirable stowed position.

From the foregoing description it is apparent that a pendant supported telescopic boom and live mast are disclosed which are pivoted to a base preferably about a common axis near the lower surface of the boom thus providing a significant mast-boom angle when stowed. A live pendant is trained around a boom winch, a boom supporting hoist, and a pendant take-up hoist with the boom supporting hoist having a greater mechanical advantage than the pendant take-up hoist. Operation of the winch in one direction controllably raises the mast to a predetermined mast-boom working angle determined by the length of the fixed pendant, and thereafter raises the boom to a desired working angle. In order to maintain a substantially constant boom angle during extension and retraction of the boom, the winch is actuated to pay out or haul in pendant, respectively. The boom and mast are controllably lowered to a stowed position by actuation of the winch in a pendant pay-out direction.

Although the best mode contemplated for carrying out the present invention has been herein shown and described, it will be apparent that modification and variation may be made without departing from what is regarded to be the subject matter of the invention.

What is claimed is:

1. In a pendant supported extensible and retractable boom pivotally supported at an inner end on a frame and having an outer end, means for extending and retracting said boom, a mast pivotally connected to the boom and having an upper end pivoted between a stowed position and a raised working position defining a predetermined mast-boom working angle, and an operator controlled winch on the frame: the improvement which comprises means for pivotally supporting said mast adjacent the lower surface of said boom; means defining a boom supporting hoist connected between the frame and the upper end of the mast; means defining a pendant take-up hoist connected between the upper end of the mast and the outer end of the boom; means defining a live pendant trained around said winch and said hoist and forming a portion of both of said hoists; and a fixed pendant connected between said mast and said boom for establishing said predetermined mast-boom working angle; actuation of said winch in one direction being effective to controllably raise said mast from said stowed position to said mast-boom working angle and thereafter to raise the boom to a selected working angle, and actuation of said winch in the opposite direction being effective to controllably lower said boom and said mast into said stowed position, said live pendant having multiple parts of pendant line included in said boom supporting hoist and a lesser number of multiple parts of pendant lines included in said pendant take-up hoist in a proportion which will cause said boom hoist to have a greater mechanical advantage than that of the pendant take-up hoist for controllably raising the mast from or lowering the mast onto the boom.

2. An apparatus according to claim 1 wherein said converging angle is at least about 10° when in said stowed position for assuring controlled raising and lowering of said mast.

3. An apparatus according to claim 1 or 2 wherein the upper end of said mast is supported by an upper surface of the boom and wherein said hoists are substantially parallel to the longitudinal axis of the boom when in the stowed position.

4. An apparatus according to claim 1 wherein the parts of rope of said boom supporting hoist is preferably about 15 and the parts of rope of said take-up up hoist is preferably about 4.

5. An apparatus according to claim 1 or 2 wherein the boom is a multi-section extensible boom having at least a base section and a tip section defining the outer end of the boom, and wherein said winch is actuated to pay out sufficient pendant therefrom and from said pendant take-up hoist during extension of said boom for maintaining said boom working angle substantially constant, and wherein said winch is actuated to haul in sufficient pendant from said pendant take-up hoist during retraction of the boom for maintaining said boom working angle substantially constant.

6. In a pendant supported multi-section telescopic boom which includes a base section pivoted on a base and a plurality of outer sections with operator controlled power means for extending and retracting the boom sections, a mast pivotally supported by the base section and having an upper portion movable between a raised working and a lowered stowed position, and an operator controlled winch on said base: the improvement which comprises means defining a boom supporting hoist connected between the upper portion of the mast and the base; means defining a pendant take-up hoist connected between the upper portion of the mast and the outer end of one of said outer boom sections; means defining a single live pendant trained around the winch and forming a portion of both the boom hoist and the pendant take-up hoist; and a fixed length pendant connected between the outer end of the base section and the upper portion of the mast to define a mast-boom working angle when pulled taut; actuation of said winch in one direction being effective to controllably raise said mast to said mast-boom working angle and thereafter raise the boom to a selected working angle, said single live pendant having multiple parts of pendant line included in said boom supported hoist and a lesser number of multiple parts of pendant line included in said pendant take-up hoist in a proportion which will cause said boom hoist to have a greater mechanical advantage than that of the pendant take-up hoist for controllably raising the mast from or lowering the mast onto the boom.

* * * * *